United States Patent [19]

Tischer

[11] Patent Number: 4,713,657

[45] Date of Patent: Dec. 15, 1987

[54] SYSTEM FOR INCREASING THE BRIGHTNESS OF A MULTIBEAM DOT-PATTERN CATHODE RAY DISPLAY TUBE

[75] Inventor: Alessandro Tischer, Saronno, Italy

[73] Assignee: U.S. Philips Corporation, New York, N.Y.

[21] Appl. No.: 856,842

[22] Filed: Apr. 21, 1986

Related U.S. Application Data

[63] Continuation of Ser. No. 457,294, Jan. 11, 1983, abandoned.

[51] Int. Cl.[4] ..... G09G 1/00

[52] U.S. Cl. ..... 340/748; 340/720

[58] Field of Search ..... 340/748, 720, 744, 724, 340/726, 723; 358/58, 60

[56] References Cited

U.S. PATENT DOCUMENTS

| | | | |
|---|---|---|---|
| 3,198,976 | 8/1965 | Starr . | |
| 3,418,518 | 12/1968 | Reese | 340/728 |
| 3,422,420 | 1/1969 | Clark | 340/726 |
| 3,768,091 | 10/1973 | Naka | 340/748 |
| 3,821,796 | 6/1974 | Ernstoff et al. | 340/703 |
| 3,976,990 | 8/1976 | Haak | 340/724 |
| 4,095,216 | 6/1978 | Spicer | 340/728 |
| 4,129,860 | 12/1978 | Yonezawa et al. | 340/728 |
| 4,259,692 | 3/1981 | D'Amato | 358/237 |
| 4,386,349 | 5/1983 | Granberg et al. | 340/728 |
| 4,438,453 | 3/1984 | Alston | 358/75 |

OTHER PUBLICATIONS

F. H. Dill, Solid-State Multiple-Electron Gun for Improved Display Cathode Ray Tube, Nov. 1978, pp. 2562-2564, IBM Technical Disclosure Bulletin, vol. 21, No. 6.

*Primary Examiner*—Marshall M. Curtis
*Attorney, Agent, or Firm*—Robert J. Kraus

[57] ABSTRACT

In order to increase the light intensity and legibility of the characters displayed on the screen of a cathode-ray tube, all dots of the same vertical line of the character or even all dots of this character are simultaneously excited. This is done by means of a multiple cathode while the line is scanned, so that excitation of the dots is repeated a predetermined number of times with short time intervals. When all the dots of the character are simultaneously excited, a shift of the picture transmitted by the multiple cathode is carried out at the same time in synchronism with and in opposite direction to the line scan, to compensate for the formation of stripes in the displayed picture which would otherwise be produced by the scan.

7 Claims, 5 Drawing Figures

FIG.1a
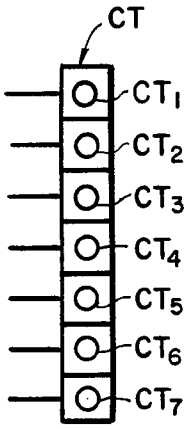
FIG.1b
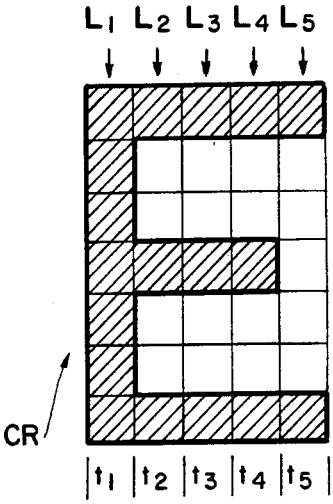
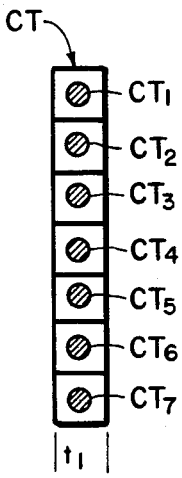
FIG.1c
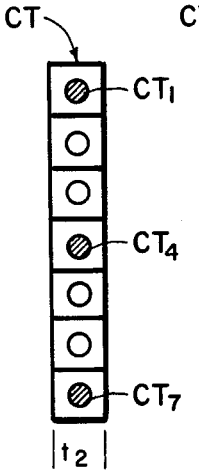
FIG.1d
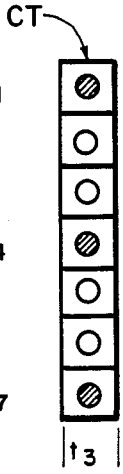
FIG.1e
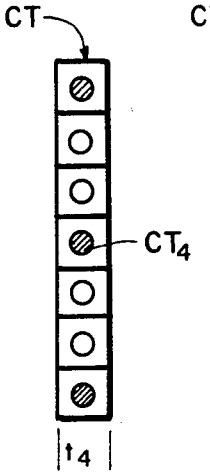
FIG.1f
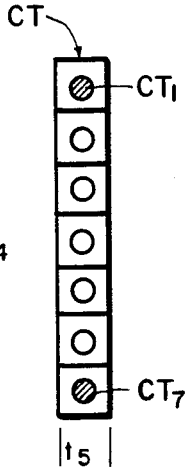
FIG.1g

SYSTEM FOR INCREASING THE BRIGHTNESS OF A MULTIBEAM DOT-PATTERN CATHODE RAY DISPLAY TUBE

This is a continuation of application Ser. No. 457,294 filed Jan. 11, 1983, now abandoned.

BACKGROUND OF THE INVENTION

The present invention relates to a method of displaying alphanumerical and graphic characters, and further relates to a terminal for use of this method.

Cathode-ray tubes which are driven in a suitable manner are usually used for the display or "visualisation" of alphanumerical and graphic output information of digital processing systems.

When the cathode-ray tube is connected to suitable logic circuits, it is possible to control the number of characters per written line as well as the number of horizontal lines forming each character, the number of written lines, the generation of characters which correspond to the character code, the memory storage of the character positions on the written page, the movement and positioning of a cursor, writing-in by means of a keyboard etc. so that terminals of different types are obtained ("active", "passive", "intelligent").

The system which is at present predominantly used for displaying characters on a screen is based on a scanning method which corresponds to the scanning method used in television. On the luminescent material (the so-called "phosphor") of the cathode-ray tube a number of defined dots are excited and light up, a train of pulses being sequentially applied to the input of the tube, which pulses correspond to the pulses which are obtained by successively reading the individual dots of each horizontal line of the characters which form part of a written line.

In the operating conditions which are at present usually required for high-resolution monitors (2000–6000 characters) it must be taken into account that the individual dot on the screen is excited every 20 milliseconds for 20–30 nanoseconds, with a duty cycle of approximately $1.10^{-6}$.

The light emission caused thereby depends on the decay properties of the luminescent materials used.

To improve the legibility of characters, a great number of parameters must be processed, such as the dimensions and shape of each character, contrast, colour, electrooptical aberrations, brightness, etc. When it is desired to increase the brightness of the character, the current of the impinging electron beam must be increased; however, this increase causes a larger diameter of the spot, as a result of which the resolution becomes poorer, and also causes a decrease in contrast due to an increase of the halo across the thickness of the luminescent material.

SUMMARY OF THE INVENTION

In view thereof the present invention has for its object to increase the light emission of the individual dots of the luminescent material on which the electron beam impinges, so that the legibility of the displayed characters is correspondingly improved, but without the above-mentioned drawbacks.

According to the invention, this object is accomplished by means of a novel display method which is characterized in that several dots of the luminescent material arranged on the same vertical line of the character to be displayed are simultaneously excited and in that such a line scan is effected that the excitation is repeated a predetermined number of times with short time intervals before it is moved in the vertical direction for the excitation of the dots of the subjacent line. This simultaneous and repeated excitation provided in the method in accordance with the invention results in an improved duty cycle, which results in a higher light emission and consequently an improved legibility of the displayed character.

This advantageous effect can be still further increased by simultaneously exciting the corresponding dots on several vertical lines of the character to be displayed, or even all dots of this character, and by having the line scan effected such that this simultaneous excitation is repeated a predetermined number of times at short time intervals, with a synchronous horizontal shift of the vertical lines in a direction opposite to the direction of line scan.

An important consequence of this shift is that the appearance of stripes produced in the character by the scan is prevented. Normally, the horizontal scan has such a speed that a stripe is formed in the picture when the duration of the excitation corresponds to the period of time for producing a complete character instead of one single dot. When the vertical lines are shifted in the opposite direction at such a speed that the speed of the horizontal scan is compensated for, the formation of stripes in the picture will be prevented from occurring, so that the character appears on the screen in a fixed position without stripes and with an optimum light intensity and legibility.

BRIEF DESCRIPTION OF THE DRAWING

The characteristics of the present invention will be better understood with reference to the accompanying drawing, in which:

FIG. 1 shows the variation of the excitation times of the several dots of a character on display with simultaneous and repeated excitation of a whole vertical line.

DESCRIPTION OF THE PREFERRED EMBODIMENT

Figure 2A:
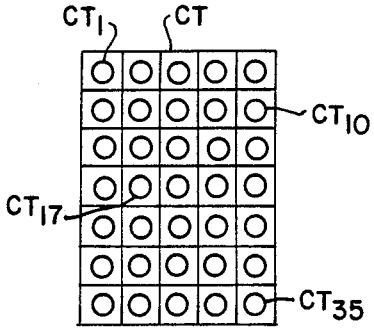
FIG. 2 shows the variation of the excitation times of the several dots of the character on display with simultaneous and repeated excitation of the whole character.
Figure 2B:
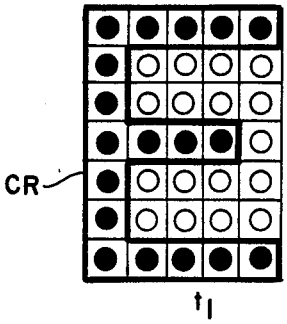
Figure 2C:
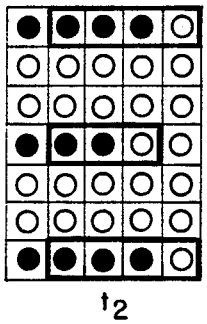
Figure 2D:
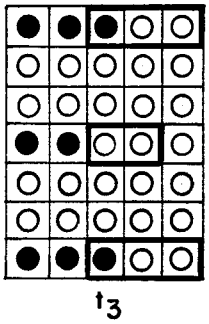
Figure 2E:
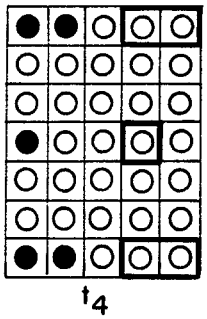
Figure 2F:
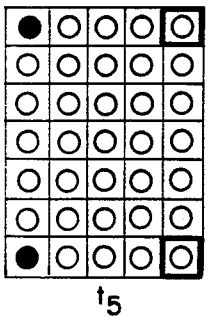

FIG. 1 shows an example of the method for displaying an alphanumerical character, in this case an E, with simultaneous and repeated excitation of the dots of a whole vertical line of this character.

FIG. 1*a* shows in detail a multiple cathode CT having seven independent emitters $CT_1$–$CT_7$, arranged on a vertical line, each having a contact pin to which pulses are applied for activation, while FIG. 1*b* shows the formation of the character CR to be displayed, which is assembled from a large number of contiguous, vertical lines $L_1$–$L_5$ corresponding to those of the emitter cathode, and FIGS. 1*c*–1*g* show the state of the above-mentioned cathode at consecutive operating instants $t_1$–$t_5$ during a line scan.

As shown in FIGS. 1c–1g, at instant $t_1$ all the emitters of the multiple cathode CT are energised to obtain a simultaneous excitation of all the dots of a vertical line of the luminescent material of the cathode ray tube, while the first vertical line $L_1$ of character CR is displayed. In contrast therewith, at instant $t_2$ when the second vertical line $L_2$ of character CR is displayed only the first, fourth and seventh emitters ($CT_1$, $CT_4$, $CT_7$) of the multiple cathode will be energised and the same is effected at instants $t_3$ and $t_4$ for the lines $L_3$ and $L_4$. Finally, at instant $t_5$, which corresponds to $L_5$ only the emitters $CT_1$ and $CT_7$ are energized.

At each of the five consecutive instants all dots of the character which form part of the same vertical line are excited, that is to say that the character is displayed by consecutive vertical lines.

This same process is used for the consecutive production of all characters on the same written line, whose dots are successively excited on the luminescent material at a time interval corresponding to the spacing desired between the characters.

Thereafter the line scanning operation is repeated several times (e.g. seven times at) short time intervals so that the simultaneous excitation of the points of several lines is repeated at a high rate, which corresponds to the horizontal scanning frequency and thus a high light intensity and good legibility of the displayed character is obtained.

As soon as this repeated scan has been ended, the scan of the next line starts. This is achieved by driving the vertical scan of the cathode-ray tube by a step-shaped signal having a magnitude which remains constant during the entire scan of a written line. The magnitude is increased only at the end of the scan of the line, by a fixed value (equal to the height of a written line plus a line space).

For the practical usage of the method of FIG. 1 a terminal can be employed which only differs from the conventional terminals by the use of a multiple cathode, which cathode is known per se, and by providing means for vertical scanning, which are suitable for effecting a step-wise scanning as described above.

In contrast therewith, FIG. 2 shows an example of the display method which for the same character E effects a simultaneous and repeated excitation of all the dots of the character.

FIG. 2a shows in greater detail a multiple cathode CT with 35 independent emitters $CT_1$–$CT_{35}$ arranged in a matrix having 7 lines and 5 columns, while FIGS. 2b–2f show the state of the above-mentioned cathode at consecutive operating instants $t_1$–$t_5$ during a line scan.

As is shown in FIGs. 2b–2f, the operating states of the various emitters $CT_1$–$CT_{35}$ are changed from one instant to the next to effect a gradual horizontal shift of the energized cathodes. This gradual shift is in synchronism with the line scan and in a direction opposite to the direction thereof. Thus, the formation of a stripe in the displayed picture which would otherwise be produced during the scanning motion is compensated for by the shift in the opposite direction of the energized cathodes, causing the displayed character to appear on the screen in a fixed position and without stripes.

If this line scan is repeated seven times with short time intervals, the excitation of these dots of the luminescent material of the cathode-ray tube will also be repeated, which results in an increase in the duty cycle and, consequently, the light intensity and the legibility of the character are improved.

Figure 3:
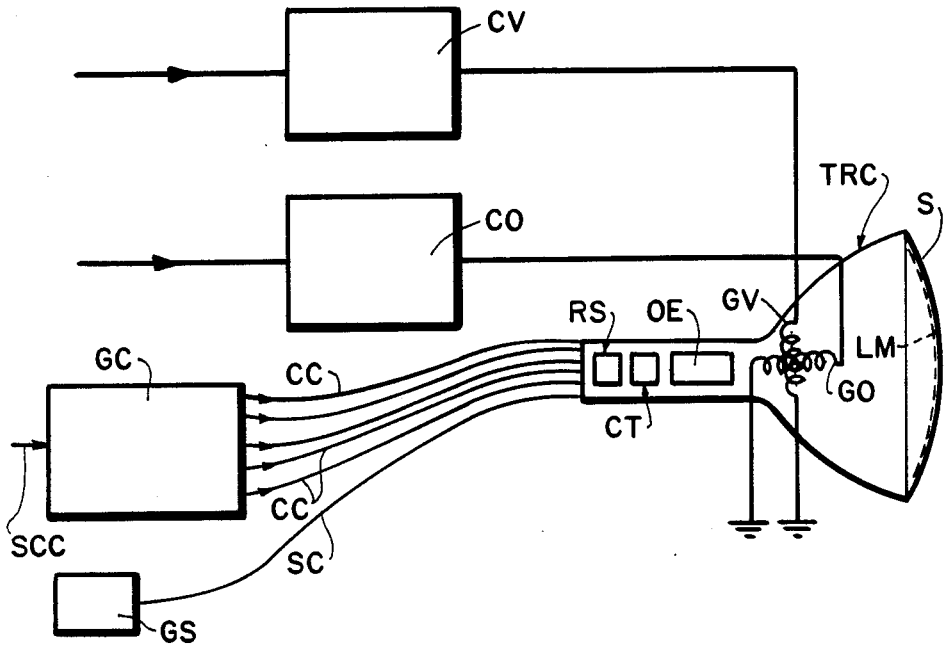
FIG. 3 is the simplified circuit diagram of an alphanumerical terminal which operates in accordance with this method and which serves for the simultaneous and repeated excitation of the whole character.

FIG. 3 shows the simplified circuit diagram of a terminal with cathode-ray tube, which enables the display of alphanumeric and graphic characters in accordance with the method of FIG. 2.

Figure 5:
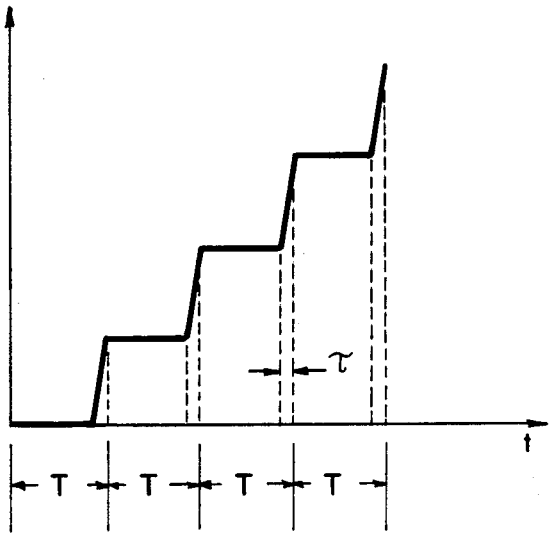
FIG. 5 shows the time diagram of the current for the vertical deflection in the terminal shown in FIG. 3.

This circuit diagram shows a cathode-ray tube TRC having a screen S, multiple-emitter cathode CT, "optical electronics" OE and yokes GO and GV for the horizontal and vertical deflection. Associated with these yokes are respective circuits CO and CV for horizontal and vertical deflection. The first circuit generates a normal sawtooth-shaped drive signal, while the second generates a step-shaped signal of the type indicated in FIG. 5. T represents the total line scanning period and $\tau$ the period of time required for the transition from one line to the other.

The multiple cathode CT is driven via shift registers RS of a character generator GC which is formed by a memory of the RAM (random access memory) type having a parallel output for columns and a controlled input for a character code signal SCC. Finally, the shift registers RS are coupled to a clock signal generator GS to effect the periodic shift of the data produced by character generator GC.

Figure 4:
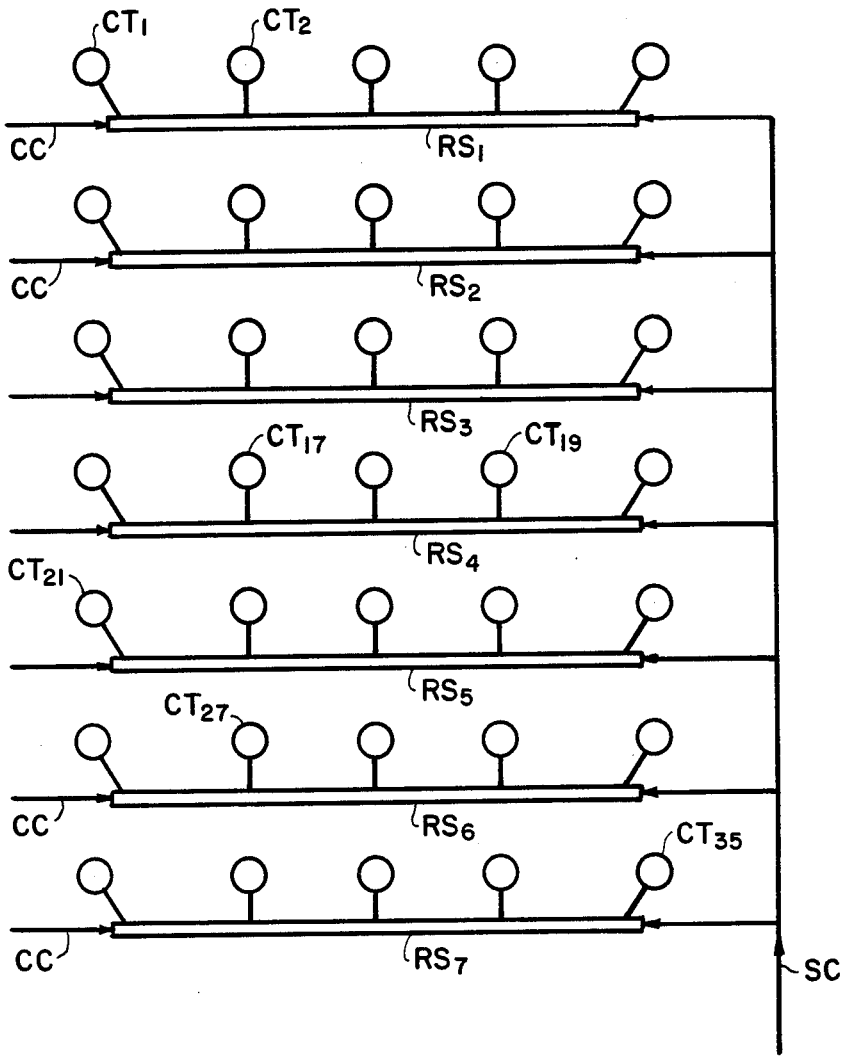
FIG. 4 shows a more detailed circuit diagram of a system for emission of the electron beam, which system is preferably used in the terminal of FIG. 3.

The operation of the multiple cathode CT and the shift registers RS for performing the method shown in FIG. 2 can be understood from the enlarged drawing of FIG. 4. In FIG. 4 $CT_1$–$CT_{35}$ represent the several independent emitters of the multiple cathode, (preferably cold semiconductor-cathodes with field effect emission), $RS_1$–$RS_7$ represent the several shift registers, which are preferably included in the multiple cathode CT, CC represents the several signals (pulses) produced by character generator GC, and SC represents the clock signal produced by clock signal generator GS.

It will be clear that registers RS respond to each clock pulse by moving the several data columns (excitation signals for the emitter-cathodes) which were produced at an earlier instant by the character generator GC, one step from left to right (looking at FIG. 4) and by inserting a new data column in the column of emitters which is located further to the left (always in accordance with FIG. 4). This results in the horizontal shift of the energized cathodes as shown in FIGS. 2b–2f.

By means of the vertical deflection circuit CV it is possible to repeat the line scan seven times so that the excitation of the relevant dots of the luminescent material LM of the cathode-ray tube is repeated, whereafter the scan of the next line is proceeded to.

The terminal and emitter cathodes of FIGS. 3 and 4, which are only shown by way of example, may of course be modified extensively, which modifications are all within the scope of the invention. So it is, for example, possible to integrate the shift registers in the semiconductor material of the cathodes themselves or to provide them around or near the cathode, or even outside the cathode-ray tube. In addition, the step-wise vertical scan can be effected such that the change from one line to the other is effected in the flyback period of the line or in the scanning period of the line plus the flyback period.

As regards the display method, a middle course for the methods of FIGS. 1 and 2 can be created by applying the simultaneous excitation of corresponding dots to a character portion comprising two or more vertical lines. It is furthermore possible to extend the simultaneous excitation of the corresponding dots to two or more characters at a time.

Further modifications will be obvious to persons skilled in the art.

What is claimed is:

1. A system for forming an image from a pattern of excited dots on a cathode ray tube luminescent screen, said dots being excited by a plurality of electron beams produced within the display tube, said system comprising:

(a) an electron beam source including a two-dimensional array of electron beam emitters for producing respective ones of said electron beams, each emitter being selectively energizable;

(b) horizontal deflection means for repeatedly horizontally deflecting the electron beams in a first direction at a predefined rate of repetition;

(c) selection means for simultaneously energizing a selected pattern of the electron beam emitters corresponding to a portion of the pattern of excited dots on the luminescent screen to which the beams are instantaneously deflected, said selection means effecting horizontal shifting of the selected pattern of electron beam emitters, in a direction opposite to said first directoion, synchronously with the horizontal deflection of the beams in said first direction, thereby maintaining a stationary image on the luminescent screen; and (d) vertical deflection means for vertically deflecting the electron beams after said beams have been horizontally deflected a predetermined number of times to repeatedly form said portion of the image.

2. A system as in claim 1 where each of the electron beam emitters comprises an electron emitting cathode.

3. A system as in claim 1 or 2 where the image comprises alphanumeric characters, said electron beam emitters being arranged to produce said alphanumeric characters.

4. A system as in claim 2 where the selection means includes a plurality of shift registers for effecting said horizontal shifting of the selected pattern of electron emitters.

5. A system for forming characters from a pattern of excited dots on a cathode ray tube luminescent screen, said dots being excited by a plurality of electron beams produced within the display tube, said system comprising:

(a) an electron beam source comprising a matrix arrangement including rows and columns of electron beam emitters for producing respective ones of said electron beams, each emitter being selectively energizable;

(b) horizontal deflection means for repeatedly horizontally scanning the electron beams across the luminescent screen in a first direction at a predefined rate of repetition;

(c) selection means for simultaneously energizing a selected pattern of the electron beam emitters corresponding to a portion of the pattern of excited dots on the luminescent screen to which the beams are instantaneously deflected, said selection means effecting horizontal shifting of the selected pattern of electron beam emitters in a direction opposite to said first direction, synchronously with the horizontal scanning of the beams in said first direction, thereby maintaining said excited dots stationary on the luminescent screen; and (d) vertical deflection means for vertically deflecting the electron beams by at least as many dots as there are beams in a column, after said beams have been horizontally scanned a predetermined number of times to repeatedly form said portion of the image.

6. A system as in claim 5 where each of the electron beam emitters comprises an electron emitting cathode.

7. A system as in claim 6 where the selection means includes a plurality of shift registers for effecting said horizontal shifting of the selected pattern of electron emitters.

* * * * *